US006290101B1

(12) United States Patent
Chang

(10) Patent No.: US 6,290,101 B1
(45) Date of Patent: Sep. 18, 2001

(54) CARTRIDGE STABILIZING PLATE FOR DUAL BARREL DISPENSERS

(76) Inventor: Peter J. Chang, 11001 Petersborough Dr., Rockville, MD (US) 20852

( * ) Notice: Subject to any disclaimer, the term of this patent is extended or adjusted under 35 U.S.C. 154(b) by 0 days.

(21) Appl. No.: 09/653,830

(22) Filed: Sep. 1, 2000

(51) Int. Cl.[7] ..... B67D 5/52
(52) U.S. Cl. ..... 222/137
(58) Field of Search ..... 222/137, 326, 222/309, 389, 391

(56) References Cited

U.S. PATENT DOCUMENTS 3,767,085 * 10/1973 Cannon et al. ..... 222/137
3,933,273 * 1/1976 Cox ..... 222/391
5,236,105 * 8/1993 Galex ..... 222/391

* cited by examiner

*Primary Examiner*—Philippe Derakshani
*Assistant Examiner*—Thach H Bui
(74) *Attorney, Agent, or Firm*—Law Offices of Royal W. Craig

(57) ABSTRACT

A stabilizing plate for a dual-barrel dispensing gun of the type having a pair of laterally-displaced and adjustable plunger shafts with end-mounted pistons for extruding compound from twin cartridge packs. The stabilizing plate spans both plunger shafts rearwardly of the pistons and engages both sides of a twin cartridge pack seated in the dual-barrel, thereby aligning the cartridge pack relative to the plunger shafts during use. This helps to maintain a proper mix ratio from both sides of said twin cartridge pack. The stabilizing plate is formed with side-by-side apertures to pass the plunger rods of the dispensing gun. The front face of the stabilizing plate is defined by radial centering channels. More specifically, two sets of radial centering channels are provided, one set on each side of the stabilizing plate (each set corresponding to a plunger shaft), and each set being a series of circular channels of increasing diameter. Preferably, the stabilizing plate has two or more channels on each side respectively sized to seat any from among the group of 750 ml, 300 ml, 150 ml, 150 ml, and 75 ml capacity cartridges of a twin cartridge pack. A pair of biasing springs are also provided, each carried on a corresponding plunger shaft behind the stabilizing plate. Set screws anchor the stabilizing plate to the plunger shafts. The stabilizing plate accommodates a range of different cartridge sizes, thereby avoiding the need to change parts each time that a different-sized cartridge(s) is used. Moreover, the stabilizing plate can be economically manufactured of molded plastic and installed onto a dual-barrel dispensing gun at minimal additional cost of time and materials.

18 Claims, 2 Drawing Sheets

CARTRIDGE STABILIZING PLATE FOR DUAL BARREL DISPENSERS

BACKGROUND OF THE INVENTION

1. Field of the Invention

The present invention relates to epoxy guns and, more particularly, to hand-operated epoxy guns of the type employing dual component cartridges and dual ejector pistons for dispensing two component materials.

2. Description of the Background

There are a wide variety of dispensing guns that are used to dispense many types of fluid compositions such as urethane, vinyl, polyester, epoxy and other plastics. Conventional dispensing guns are constructed to provide a barrel to receive a cartridge containing fluid compound which has a dispensing nozzle at one end. These dispensing guns typically have a plunger shaft that is driven by a manual trigger. A piston disk is mounted at the end of the plunger shaft, and hand operation of the trigger moves the plunger shaft and piston through the cartridge to urge compound therefrom. In some cases, such dispensing guns are adapted for use with a double cartridge for dispensing two-component chemical systems such as epoxy and hardener. These are twin-barrel epoxy guns have a pair of plunger shafts commonly driven by a manual trigger mechanism. Some of the two-component chemicals such as epoxy/hardener are of different viscosities which create uneven ejection pressures on the ejection pistons. Additionally, some of these materials are very thick and difficult to eject and require considerable pressure.

For example, U.S. Pat. No. 5,104,005 to Schneider, Jr. et al. issued Apr. 14, 1992 discloses a dual-component gun having a high-pressure ratchet assembly. Also of interest is U.S. Pat. No. 3,767,085 to Cannon et al. which shows a double barrel syringe having a common mixing chamber. Received in the barrels are cartridges containing the two constituents to be mixed, each cartridge having a rear plug which is engaged by a piston. The dual piston rods are urged axially inwardly so that pistons 71 and 72 (FIG. 1 therein) are urged their full distance through the cartridges.

It is greatly advantageous if these dual-cartridge type guns can accommodate a range of the various-sized dual-compound cartridges that are now available. Otherwise, it would be necessary to purchase multiple guns, one for each cartridge size. A helpful feature in this latter regard is shown in U.S. Pat. No. 5,197,635 to the inventor herein and issued on Mar. 30, 1993. The '635 patent discloses a snap-on piston assembly provided at the ends of the dual plunger shafts (see FIG. 9 therein). The snap-on piston assembly 450 includes a piston 455, and a hollow cylindrical base 460 on which piston 455 is mounted. When a plunger shaft is fully inserted within base 460, a detent ball-bearing 510 releasibly locks it onto the end of the plunger shaft. Many shapes and sizes of pistons 455 may be easily interchanged with this assembly in order to accommodate the various twin epoxy cartridges now available.

While the above-described snap-on piston assembly 450 helps to accommodate different sized cartridges, it also creates a need to secure the various dual cartridges in place despite fixed-size barrels. Often, odd-sized cartridges are used and these must be centered and secured regardless of their size. Otherwise, the cartridges may become loose or uneven and this will cause one side of the tube to extrude more material than the other side. With epoxy or any other two-part compound, the mix ratio is of utmost importance. Centering the cartridges also helps to prevent blowback, a problem of compound extruding rearwardly which in most cases destroys the cartridge and wastes expensive compound. One known attempt at a solution is a spring-biased centering disk that rides the plunger shaft behind the piston. Once the pistons are inserted into the cartridges, the centering disk behind each piston is spring-biased into the rear apertures of the cartridges to thereby keep them centered relative to the plunger shafts. These centering disks are commercially available on certain dispensing guns such as the Cox model PPM-300. Unfortunately, for each piston size, a different centering disk must be kept on hand. In addition, each time a cartridge is exchanged for one of a different size, a different-sized centering disk must be assembled onto the plunger shaft, and this is a tedious and time-consuming process.

It would be greatly advantageous to provide a means for securing and centering various sized cartridges without ever having to touch, adjust, change or remove the centering components for any reason.

SUMMARY OF THE INVENTION

It is, therefore, an object of the present invention to provide a cartridge stabilizing plate for dual barrel dispensers which centering the cartridges on the plunger shafts and thereby helps to maintain the proper mix ratio of epoxy or any other two-part compound, and also helps to prevent blowback (unwanted compound extruding rearwardly).

It is another object to provide a cartridge stabilizing plate as described above that accommodates a range of different piston sizes, thereby avoiding the need to change parts each time that the size of the cartridge(s) changes.

It is a further object to provide a cartridge stabilizing plate as described above that can be economically manufactured and installed onto a dual-barrel dispensing gun at least cost of time and materials.

According to the present invention, the above-described and other objects are accomplished by providing a stabilizing plate for a dual-barrel dispensing gun of the type having a pair of laterally-displaced and adjustable plunger shafts with end-mounted pistons for extruding compound from both cartridges of a variety of sizes of twin cartridge packs. The cartridge stabilizing plate spans both plunger shafts rearwardly of the pistons for engaging both sides of the twin cartridge pack seated in the barrel in order to align the cartridge pack relative to the plunger shafts during use. This feature helps to maintain a proper mix ratio from both sides of said twin cartridge pack. Moreover, the stabilizing plate is capable of accommodating a range of different cartridge sizes, thereby avoiding the need to change parts each time that a different-sized cartridge is used. The stabilizing plate is formed with side-by-side apertures to pass the plunger rods of the dispensing gun, and the apertures may be formed as incremental holes corresponding to the incremental lateral positions of the plunger rods relative to the various standard cartridge sizes. The stabilizing plate is defined by a front face having a series of radial centering channels of increasing diameter, for example, two channels on one side respectively sized to seat 750 ml and 300 ml capacity cartridges of a twin cartridge pack, and three channels on another side respectively sized to seat 300 ml, 150 ml, and 75 ml capacity cartridges. A pair of biasing springs are carried, one on each corresponding plunger shaft behind the stabilizing plate, and a pair of set screws anchor both sides of the stabilizing plate to a corresponding plunger shaft. The stabilizing plate centers the cartridges on the plunger shafts and thereby helps to maintain the proper mix ratio of epoxy or any other two-part compound, and also helps to prevent blow-back (unwanted compound extruding rearwardly). The stabilizing plate can be adapted to accommodate a range of different cartridge sizes, thereby avoiding the need to change parts each time that a different-sized cartridge(s) is used. Moreover, the stabilizing plate can be economically manufactured of molded plastic and installed onto a dual-barrel dispensing gun at minimal additional cost of time and materials.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The basic design concept embodied in the present invention is a cartridge stabilizing plate that spans the plunger shafts in a dual-barrel dispensing gun and engages both cartridges in order to center and stabilize them during use.

Figure 1:
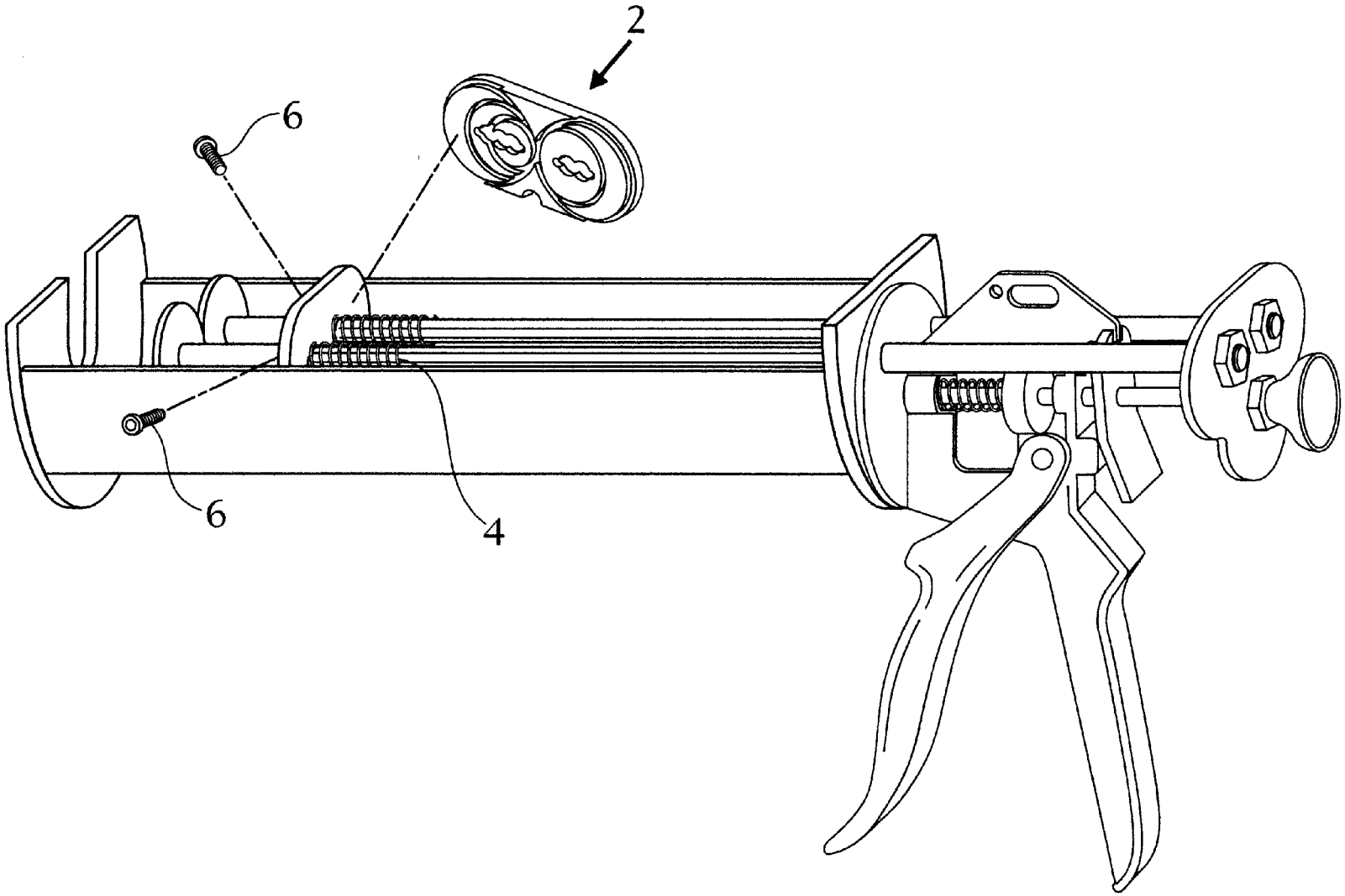
FIG. 1 is front perspective view of the cartridge stabilizing plate 2 installed into a dual-barrel dispensing gun with compression springs 4 and retainer screws 6 according to one embodiment of the present invention.

FIG. 1 is front perspective view of the cartridge stabilizing plate 2 installed into an otherwise dual-barrel dispensing gun and secured therein by compression springs 4 and retainer screws 6 according to one embodiment of the present invention.

The illustrated stabilizing plate 2 is an oblong disk with a series of radial centering channels in the front face thereof. Stabilizing plate 2 may be economically formed of molded plastic, although machined metal or other durable materials are also acceptable.

Stabilizing plate 2 may be installed during original manufacturing of the gun, or it may be distributed separately as a retrofit part. In either case, the stabilizing plate 2 is installed simply by inserting a biasing spring 4 onto the end of each plunger shaft, and then inserting the stabilizing plate 2 onto both plunger shafts, securing the stabilizing plate 2 to both plunger shaft by use of a retainer screw 6, and finally by installing pistons on the ends of each of the dual plunger shafts.

Retainer screws 6 are conventional set screws that are threaded radially into each plunger shaft in advance of the stabilizing plate 2. This way, retainer screws 6 maintain a set minimum distance between the stabilizing plate 2 and pistons.

In operation, the plunger shafts are manually pulled back and are fully retracted in order to insert the desired epoxy cartridges. Note that the biasing springs 4 limit the rearward pull of the stabilizing plate 2 and keep it off of the back wall of the epoxy gun. The desired epoxy cartridges are seated side-by-side within the dual-barrel, and the plungers are advanced until the pistons enter rearwardly into the epoxy cartridges. Once the pistons are inside, the cartridge stabilizing plate 2 is advanced into engagement with the epoxy cartridges. This occurs automatically, although the resulting engagement should be checked to ensure that it is proper. The "engagement" comprises the rear rims of the epoxy cartridges finding their way into the corresponding radial channels of the stabilizing plate 2, and becoming securely seated therein. The gun's trigger may then be retracted by hand and the drive mechanism will bear against the plunger shafts to simultaneously urge them forward. Further retraction of the trigger is converted into lateral movement of the plunger shafts, and the stabilizing plate 2 keeps the plunger shafts and pistons aligned within the cartridges. The novel addition of the stabilizing plate 2 adds a simple and effective feature to ensure a proper mix ratio and to prevent blowback, thereby improving control over the bead of epoxy and ultimately the quality of the job.

Preferably, the stabilizing plate 2 of the present invention is employed in combination with snap-on pistons at the ends of the dual plunger shafts as taught in U.S. Pat. No. 5,197,635 to the inventor herein. The '635 patent discloses a snap-on piston assembly provided at the end of each of the dual plunger shafts. The snap-on piston assembly generally includes a piston mounted on a hollow cylindrical receptacle, and a detent ball-bearing inserted in the receptacle to releasibly lock the piston onto the end of the plunger shaft. Given this configuration in combination with the stabilizing plate 2 of the present invention, many shapes and sizes of cartridges may easily be inserted and stabilized simply by interchanging appropriately-sized snap-on pistons without having to disassemble and reassemble the piston shaft. Otherwise, such as with the commercially-available Cox PPM-300 dispensing gun, frequent assembly and disassembly of the piston shaft is required because each time a different size of cartridges is desired it is necessary to change to the appropriately-sized piston and centralizing disk as well. This takes a skilled workman 15 to 20 minutes using an assortment of the proper tools.

The stabilizing plate of the present invention will now be described in more detail.

Figure 2:
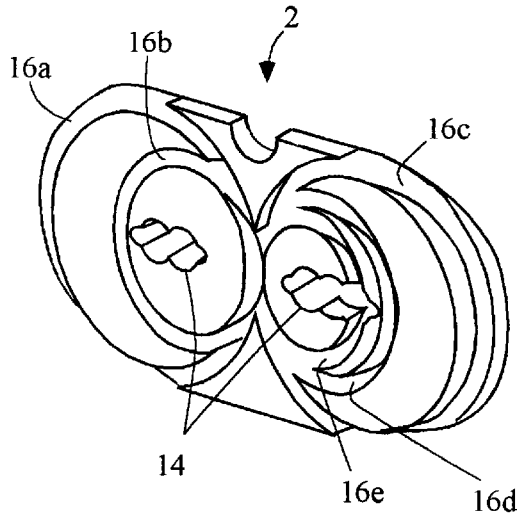
FIG. 2 is front perspective view of the cartridge stabilizing plate 2.

FIG. 2 is front perspective view of the cartridge stabilizing plate 2. The stabilizing plate 2 includes side-by-side apertures 14 to pass the plunger rods. Note that with most commercially-available dual-barrel dispensing guns having the ability to accommodate various-sized cartridges, the plunger shafts need to be disassembled and reassembled to adjust the separation there between. The stabilizing plate 2 accommodates this feature by expanding the side-by-side apertures 14. Specifically, the side-by-side apertures 14 are both formed as elongate holes to pass the plunger rods in a range of lateral positions. Preferably, although not necessarily, the side-by-side apertures 14 are formed as incremental holes. The increments correspond to the incremental lateral positions of the rods relative to the various standard cartridge sizes which are commercially available. This serves to seat the plunger rods at the appropriate discrete position. The front face of the stabilizing plate 2 is defined by a series of radial centering channels (or grooves) 16*a, b, c . . . n* of increasing diameter. The incremental diameters of the centering channels 16*a, b, c . . . . n* generally corresponds to the diameters of the various commercially-available dual-cartridge ratio packs sold presently.

Figure 3:
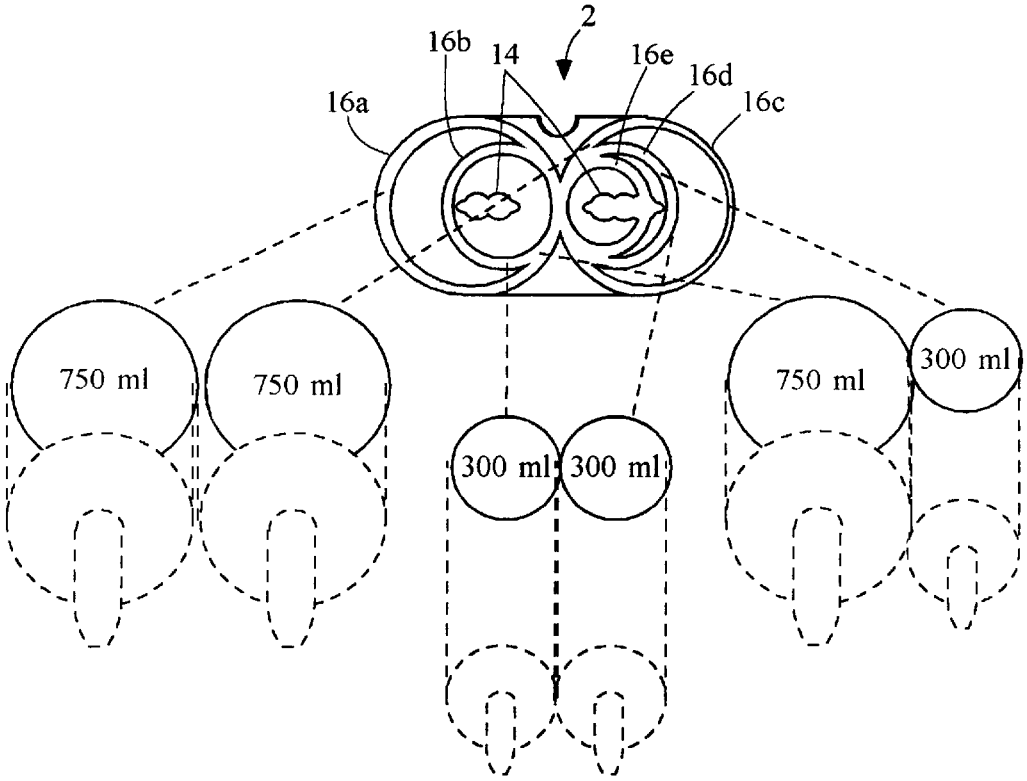
FIG. 3 is a front perspective view of the cartridge stabilizing plate 2 illustrating various cartridge sizes that can be accommodated.

FIG. 3 is a front perspective view of the cartridge stabilizing plate 2 illustrating various cartridge pack sizes that can be accommodated. The cartridge packs typically comprise two side-by-side cartridges that are integrally joined at the center. The side-by-side cartridges may be equally or oddly sized. For instance, existing cartridge packs are provided in 300 ml by 300 ml capacities, or in 300 ml×150 ml, 300 ml×75 ml, 750 ml×300 ml, 750 ml×150 ml, and 750 ml×75 ml capacities. To accommodate this range, one side of the cartridge stabilizing plate 2 must contain two channels 16*a* and *b,* respectively sized to seat 750 ml and 300 ml capacities. The other side of the cartridge stabilizing plate 2 must contain three channels 16*c, d* and *e,* respectively sized to seat 300 ml, 150 ml, and 75 ml capacities. In each case, the side-by-side apertures 14 are formed with an incremental hole positioned directly at the center of a corresponding channel 16*a, b, c . . . n* to have the piston shaft laterally move to accommodate various cartridges without disassembly or reassembly of the piston shaft.

The above-described stabilizing plate 2 centers the cartridges on the plunger shafts and thereby helps to maintain the proper mix ratio of epoxy or any other two-part compound, and also helps to prevent blow-back (unwanted compound extruding rearwardly). The stabilizing plate 2 accommodates a range of different cartridge sizes, thereby avoiding the need to change parts each time that a different-sized cartridge(s) is used. Moreover, the stabilizing plate can be economically manufactured of molded plastic and installed onto a dual-barrel dispensing gun at minimal additional cost of time and materials.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. In a dispensing gun comprising a dual-barrel with a pair of laterally-displaced plunger shafts with end-mounted pistons, a cartridge stabilizing plate spanning both plunger shafts rearwardly of said pistons for engaging both sides of a twin cartridge pack seated therein in order to align said cartridge pack relative to said plunger shafts during use;

whereby said stabilizing plate helps to maintain a proper mix ratio from both sides of said twin cartridge pack.

2. The cartridge stabilizing plate according to claim 1, further comprising means for accommodating a range of different cartridge sizes, thereby avoiding the need to change parts each time that a different-sized cartridge is used.

3. The cartridge stabilizing plate according to claim 1, further comprising side-by-side apertures to pass the plunger rods of said dispensing gun.

4. The cartridge stabilizing plate according to claim 3, wherein said side-by-side apertures are formed as incremental holes corresponding to incremental lateral positions of the plunger rods relative to various standard cartridge sizes.

5. The cartridge stabilizing plate according to claim 3, wherein said stabilizing plate is defined by a front face having a series of radial centering channels of increasing diameter.

6. The cartridge stabilizing plate according to claim 5, wherein the front face of the stabilizing plate has at least two channels on each side respectively sized to seat any from among the group of 750 ml, 300 ml, 150 ml, 150 ml, and 75 ml capacity cartridges of a twin cartridge pack.

7. The cartridge stabilizing plate according to claim 4, wherein said stabilizing plate is defined by a front face having a series of radial centering channels of increasing diameter, and each incremental hole is positioned directly at the center of a corresponding channel.

8. The cartridge stabilizing plate according to claim 7, wherein said channels are defined by molded plastic.

9. A dispensing gun, comprising:

a handle assembly including a manually-operable trigger;

a dual-barrel assembly joined to said handle assembly for seating a twin pack cartridge;

a drive mechanism actuated by said trigger;

a pair of laterally-displaced plunger shafts having end-mounted pistons, said plunger shafts being actuated by said drive mechanism for advancement of said pistons;

a cartridge stabilizing plate spanning both plunger shafts rearwardly of said pistons for engaging both sides of a twin cartridge pack seated in said dual-barrel assembly in order to align said cartridge pack relative to said plunger shafts during use;

whereby said stabilizing plate helps to maintain a proper mix ratio from both sides of said twin cartridge pack.

10. The dispensing gun according to claim 9, wherein said stabilizing plate further comprises means for accommodating a range of different cartridge sizes, thereby avoiding the need to change parts each time that a different-sized cartridge is used.

11. The dispensing gun according to claim 9, wherein said stabilizing plate further comprises means for allowing substitution of a range of different cartridge sizes without a need for disassembly and reassembly of the piston shaft.

12. The dispensing gun according to claim 9, wherein said stabilizing plate further comprises side-by-side apertures to pass the plunger rods of said dispensing gun.

13. The dispensing gun according to claim 12, wherein said side-by-side apertures are formed as incremental holes corresponding to incremental lateral positions of the plunger rods relative to various standard cartridge sizes.

14. The dispensing gun according to claim 12, wherein said stabilizing plate is defined by a front face having a series of radial centering channels of increasing diameter.

15. The dispensing gun according to claim 14, wherein the front face of the stabilizing plate has two channels on one side respectively sized to seat 750 ml and 300 ml capacity cartridges of a twin cartridge pack, and three channels on another side respectively sized to seat 300 ml, 150 ml, and 75 ml capacity cartridges.

16. The dispensing gun according to claim 13, wherein said stabilizing plate is defined by a front face having a series of radial centering channels of increasing diameter, and each incremental hole is positioned directly at the center of a corresponding channel.

17. The dispensing gun according to claim 11, further comprising a pair of biasing springs riding a corresponding plunger shaft behind said stabilizing plate.

18. The dispensing gun according to claim 9, further comprising a pair of set screws each anchoring one side of said stabilizing plate to a corresponding plunger shaft.

* * * * *